US006470704B2

(12) United States Patent
Shibata et al.

(10) Patent No.: US 6,470,704 B2
(45) Date of Patent: Oct. 29, 2002

(54) RECEIVER-INTEGRATED CONDENSER FOR A VEHICLE

(75) Inventors: Kazuji Shibata, Kariya (JP); Yoshio Yoshida, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/989,264

(22) Filed: Nov. 20, 2001

(65) Prior Publication Data

US 2002/0073730 A1 Jun. 20, 2002

(30) Foreign Application Priority Data

Dec. 19, 2000 (JP) ..... 2000-385562

(51) Int. Cl.[7] ..... F25B 39/04
(52) U.S. Cl. ..... 62/509; 165/173
(58) Field of Search ..... 62/509, 507, 474; 165/110, 132, 173

(56) References Cited

U.S. PATENT DOCUMENTS 5,546,761 A * 8/1996 Matsuo et al. ..... 62/509
5,875,650 A * 3/1999 Nobuta et al. ..... 62/509
5,927,102 A * 7/1999 Matsuo et al. ..... 62/509
6,397,627 B1 * 6/2002 Aki et al. ..... 62/509

FOREIGN PATENT DOCUMENTS

JP 8-183325 7/1996

* cited by examiner

*Primary Examiner*—Denise L. Esquivel
*Assistant Examiner*—Melvin Jones
(74) *Attorney, Agent, or Firm*—Harness, Dickey & Pierce, PLC

(57) ABSTRACT

In a core portion of the receiver-integrated condenser, a condensing portion is disposed at an upper side of a super-cooling portion. A receiving unit is disposed at one end side of the core portion in a width direction, and refrigerant is U-turned in a refrigerant passage of the super-cooling portion at the other end side of the core portion in the width direction. In addition, a refrigerant outlet of the super-cooling portion is provided at the one end side of the core portion, a connector connected to the refrigerant outlet is disposed at a direct lower side of the refrigerant outlet, and the connector has a bottom surface used as a connecting surface connected with a pipe connector of a refrigerant pipe.

14 Claims, 7 Drawing Sheets

RECEIVER-INTEGRATED CONDENSER FOR A VEHICLE

CROSS-REFERENCE TO RELATED APPLICATION

This application is related to Japanese Patent Application No. 2000-385562 filed on Dec. 19, 2000, the contents of which are hereby incorporated by reference.

BACKGROUND OF THE INVENTION

1. Field of the Invention

The present invention relates to a pipe connection structure of a receiver-integrated condenser in a refrigerant cycle system for a vehicle.

2. Description of Related Art

In a receiver-integrated condenser 110 arranged integrally with a radiator 161 in a vehicle, as shown in FIGS. 7A, 7B, a condensing portion 125 is disposed at an upper side in a core portion 113, and refrigerant after passing through the condensing portion 125 is introduced into a receiving unit 120 to be separated into gas refrigerant and liquid refrigerant. Further, liquid refrigerant within the receiving unit 120 flows through a super-cooling portion 126 disposed at a lower side in the core portion 110 to be super-cooled. In addition, a connector portion 140 used as a refrigerant outlet of the core portion 113 is positioned at one end side of the condenser 110 in a width direction, and is arranged at a middle position in the vehicle in a vehicle right-left direction. On the other hand, the receiving unit 120 is positioned at an end side of the condenser 110 opposite to the connector portion 140. In addition, for improving assembling performance of the condenser 110 in the vehicle and for reducing a mounting space of the condenser 110, a connector 142 for being connected to the connector portion 140 is connected to an upstream end of a refrigerant pipe 141 disposed at a front lower side of the condenser 110, and a downstream end of the refrigerant pipe 141 is positioned at the side of the receiving unit 120 to be connected to an outlet connector 133 used as a connection portion of a high-pressure liquid-refrigerant pipe. However, in this case, as shown in FIG. 7B, the connector portion 140 and the connector 142 greatly protrude to a vehicle front side, and the mounting performance of the condenser 110 on the vehicle may be deteriorated.

On the other hand, in a receiver-integrated condenser described in JP-A-8-183325, a refrigerant outlet portion of the super-cooling portion and a connection portion connecting with a high-pressure liquid-pipe is disposed at the same side as a receiving unit in the width direction of the condenser. However, in this case, the connection portion is disposed to protrude to a side of the receiving unit, and the mounting performance of the condenser on the vehicle is deteriorated. In addition, because the refrigerant outlet portion of the super-cooling portion is provided at a direct lower side of the receiving unit, a cap member of a bottom portion of the receiving unit cannot be detachable.

SUMMARY OF THE INVENTION

In view of the foregoing problems, it is an object of the present invention to improve mounting performance of a receiver-integrated condenser on a vehicle, in which a receiving unit is positioned at one end side of the condenser in a width direction, and a connection portion for connecting a refrigerant outlet pipe is disposed at the same side as an arrangement position of the receiving unit.

According to the present invention, a receiver-integrated condenser for a refrigerant cycle system of a vehicle includes a condensing portion for cooling and condensing refrigerant discharged from a compressor of the refrigerant cycle system, a receiving unit which is disposed to separate refrigerant from the condensing portion into gas refrigerant and liquid refrigerant and to store liquid refrigerant therein, a super-cooling portion for super-cooling liquid refrigerant from the receiving unit, and a connector connected to a refrigerant outlet portion of the super-cooling portion. In the receiver-integrated condenser, the super-cooling portion is disposed at a lower side of the condensing portion in a core portion, and the receiving unit is disposed at one end side of the core portion in a width direction of the core portion to extend in a vertical direction perpendicular to the width direction. The super-cooling portion is disposed to define a refrigerant passage, in such a manner that refrigerant is U-turned in the refrigerant passage at the other end side of the core portion in the width direction, and the refrigerant outlet portion of the super-cooling portion is positioned at the one end side in the width direction. In the receiver-integrated condenser, the connector is disposed at a lower side of the refrigerant outlet portion, and the connector has a refrigerant outlet port opened toward downwardly and a bottom surface used as a connection surface connecting with a pipe connector of the refrigerant pipe. Accordingly, the pipe connector of the refrigerant pipe can be disposed at a direct lower side of the connector of the refrigerant outlet portion, and the connection between the connector of the refrigerant outlet portion of the super-cooling portion and the pipe connector can be readily performed. Thus, the connection portion between the connector of the refrigerant outlet portion of the super-cooling portion and the pipe connector can be arranged in a lower mounting area of the receiver-integrated condenser, and the mounting performance of the receiver-integrated condenser on the vehicle can be improved. As a result, the connector and the pipe connector are not positioned directly under the receiving unit, and a cap member disposed at a bottom portion of the receiving unit can be detachably disposed.

Alternatively, the connector is connected to the refrigerant outlet portion of the super-cooling portion to be shifted to a side of the receiving unit when being viewed from an upper side of the receiving unit. In this case, the connector has a refrigerant outlet port opened toward upwardly, and a top surface used as a connection surface connecting with a pipe connector of the refrigerant pipe. Accordingly, connection operation of the connector of the refrigerant outlet portion of the super-cooling portion and the pipe connector can be readily performed. Even in this case, the cap member of the receiving unit can be detachably disposed.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
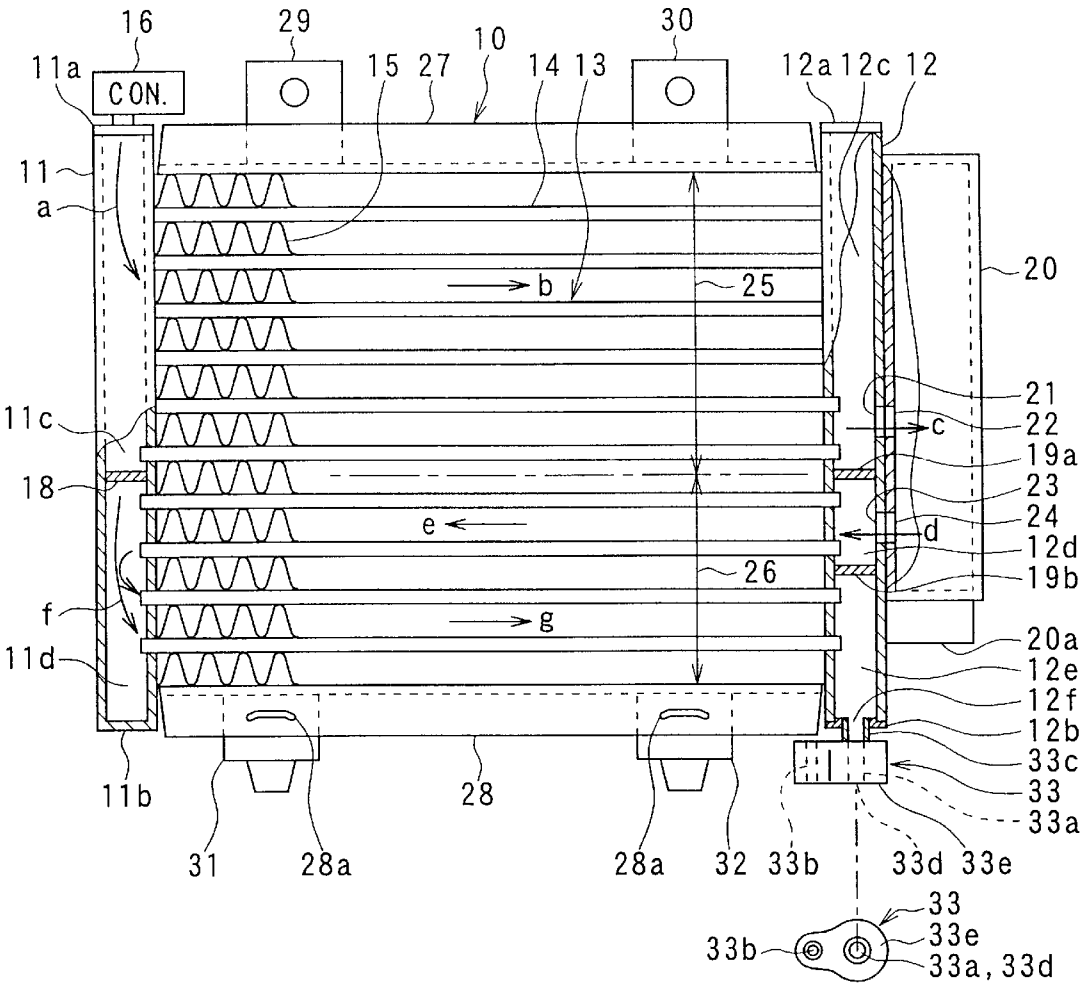
FIG. 1 is a front view showing a receiver-integrated condenser according to a first preferred embodiment of the present invention.
Figure 2:
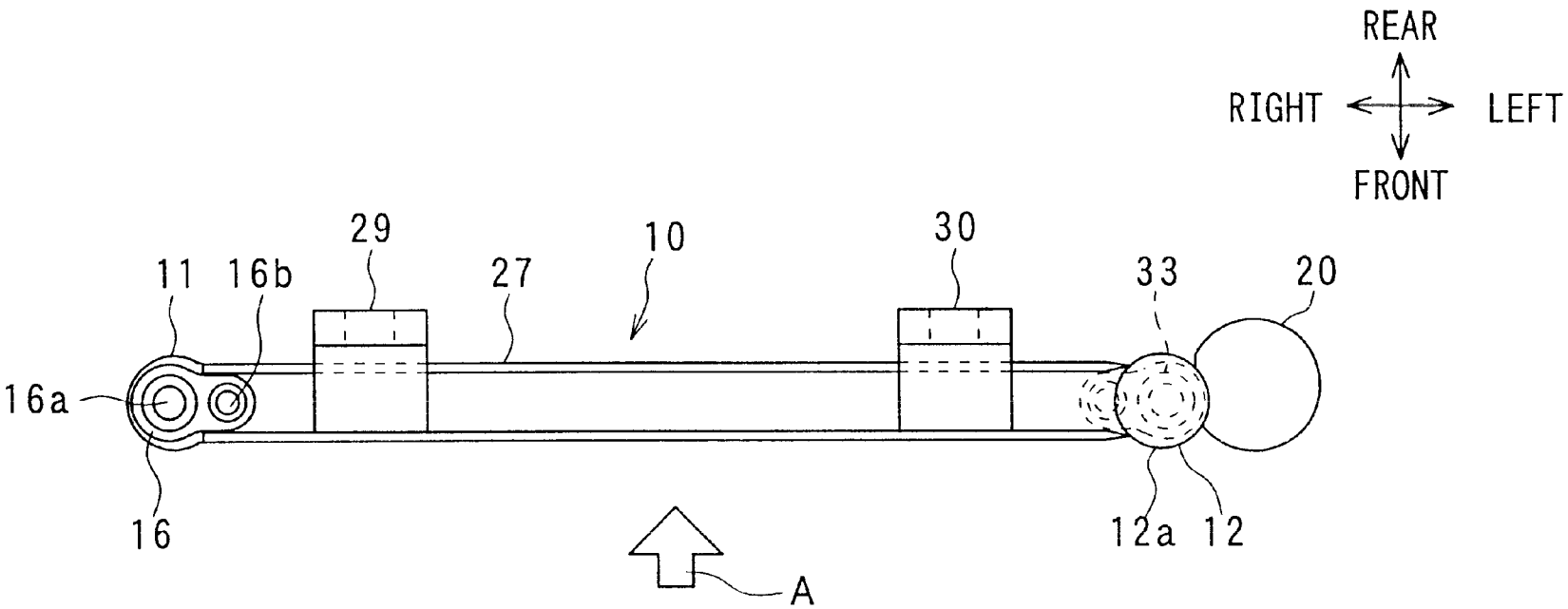
FIG. 2 is a top view of the receiver-integrated condenser in FIG. 1.

A first preferred embodiment of the present invention will be now described with reference to FIGS. 1–4. A receiver-integrated condenser shown in FIGS. 1 and 2 is for a refrigerant cycle system for a vehicle. The receiver-integrated condenser 10 includes first and second header tanks 11, 12 disposed to have a predetermined distance therebetween. Each of the first and second header tanks 11, 12 is formed into an approximate cylindrical shape to extend vertically in an up-down direction. Both upper and lower openings of the first header tank 11 are closed by caps 11*a*, 11*b*, and both upper and lower openings of the second header tank 12 are closed by caps 12*a*, 12*b*. A heat-exchanging core portion 13 is disposed between the first and second header tanks 11, 12.

In the first embodiment, the receiver-integrated condenser 10 is a multi-flow type. The core portion 13 includes plural flat tubes 14 through which refrigerant flows in a horizontal direction, and plural corrugated fins 15 each of which is disposed between adjacent flat tubes 14. The flat tubes 14 are disposed in parallel with each other to be connected to both the first and second header tanks 11, 12. That is, one side end of each tube 14 is connected to the first header tank 11 to communicate with an interior of the first header tank 11, and the other side end of each tube 14 is connected to the second header tank 12 to communicate an interior of the second header tank 15.

A refrigerant inlet-side connector 16 is disposed to be connected to the upper side cap 11*a* of the first header tank 11. The refrigerant inlet-side connector 16 is for being connected to a refrigerant pipe 83 (see FIGS. 3, 4) at a refrigerant discharge side of a compressor 80.

In the first embodiment of the present invention, a single separator 18 is disposed within the first header tank 11 to partition the interior of the first header tank 11 into both spaces 11*c*, 11*d* in the up-down direction. On the other hand, a single first separator 19*a* is disposed within the second header tank 12 at a height position approximately equal to that of the separator 18, and a single second separator 19*b* is disposed within the second header tank 12 at a position lower than the first separator 19*a* by a predetermined distance. Therefore, the interior of the second header tank 12 is partitioned into an upper side space 12*c*, a lower side space 12*d*, and a refrigerant outlet space 12*e* in the up-down direction.

The second header tank 12 is integrated with a receiving unit 20 extending in the up-down direction. The receiving unit 20 integrated with the second header tank 12 is for separating refrigerant into gas refrigerant and liquid refrigerant, and for storing liquid refrigerant in the refrigerant cycle system. The receiving unit 20 is formed approximately into a cylindrical shape, and has a height slightly lower than that of the second header tank 12. The receiving unit 20 is disposed at an outer side (i.e., the side opposite to the core portion 13) of the second header tank 12 to be bonded to an outer side surface of the second header tank 12.

A cap member 20*a* is detachably attached to a bottom portion of the receiving unit 20, so that a member such as a desiccant, a filter disposed in the receiving unit 20 can be checked and exchanged. Therefore, in the first embodiment, the cap member 20*a* is detachably fixed to the bottom portion of the receiving unit 20 using a screw, for example. An elastic seal member (not shown) such as an O-ring is disposed in a fitting portion between the cap member 20*a* and a wall surface of the bottom portion of the receiving unit 20*a*, so that sealing performance in the attachment portion of the cap member 20*a* can be ensured.

Communication holes 21, 22 are provided in walls of the second header tank 12 and the receiving unit 20 at a position upper than the first separator 19*a*, so that the upper space 12*c* of the second header tank 12 upper than the first separator 19*a* communicates with the receiving unit 20. Further, communication holes 23, 24 are provided in the walls of the second header tank 12 and the receiving unit 20 at a position lower than the first separator 19*a*, so that the lower space 12*d* of the second header tank 12 between the first and second separators 19*a*, 19*b* communicates with a lower side space within the receiving unit 20. Therefore, liquid refrigerant stored in the receiving unit 20 can be introduced into the lower space 12*d* of the second header tank 12. Accordingly, refrigerant introduced from the inlet side connector 16 flows meanderingly in the receiver-integrated condenser 10 as shown by arrows "a"–"g", and is introduced into the refrigerant outlet space 12*e* of the second header tank 12.

The core portion 12 is constructed by a condensing portion 25 positioned at an upper side from the separators 18, 19*a*, and a super-cooling portion 26 positioned at a lower side from the separators 18, 19*a*. In the condensing portion 25, gas refrigerant discharged from a compressor 80 of the refrigerant cycle system is heat-exchanged with outside air blown by a cooling fan 62 (see FIG. 3) to be cooled and condensed. On the other hand, in the super-cooling portion 26, liquid refrigerant separated from gas refrigerant in the receiving unit 20 is introduced and is heat-exchanged with outside air to be super-cooled.

Accordingly, in the first embodiment of the present invention, the receiver-integrated condenser 10 construct the condensing portion 25, the receiving unit 20 and the super-cooling portion 26, in this order from an upstream side in a refrigerant flow. In addition, the condensing portion 25, the receiving unit 20 and the super-cooling portion 26 are integrally formed.

In a normal state of a refrigerant sealing amount in the refrigerant cycle system, the interface between the gas refrigerant and liquid refrigerant within the receiving unit 20 is positioned at a middle height position between the separator 19*a* and a top end surface of the receiving unit 20.

Side plates 27, 28 extending in the right-left direction in FIG. 1 are disposed at upper and lower ends of the core portion 13, respectively, for reinforcing both the upper and lower ends of the core portion 13. Both left and right ends of each side plate 27, 28 are connected to the first and second header tanks 11, 12, respectively.

Brackets 29, 30 are integrally connected to the upper side plate 27 at both positions in the right-left direction. An upper portion of the receiver-integrated condenser 20 is attached to an upper side tank of a radiator 61 through the brackets 29, 30. However, the upper portion of the receiver-integrated condenser 10 can be attached to a fixing portion of the vehicle.

On the other hand, elastic supporting members 31, 32 are disposed in the lower side plate 28 at both positions in the right-left direction to protrude downwardly. The lower portion of the receiver-integrated condenser 10 can be elastically supported on a supporting member 61*a* provided in a lower side tank of the radiator 61 through the elastic supporting members 31, 32. Alternatively, the lower portion of the receiver-integrated condenser can be elastically supported on a supporting member of a vehicle frame 86 (see FIGS. 3 and 4).

Upper portions of the elastic supporting members 31, 32 are press-fitted into an inner side of the lower side plate 28 having a U-shaped cross section, and thereafter, pieces (not shown) formed in slit portions 28*a* of the lower side plates 28 are fasten to the upper portions of the supporting members, so that the elastic members 31, 32 are fixed to the lower side plate 28.

The refrigerant outlet space 12*e* of the super-cooling portion 26 is provided in the lower side portion within the second header tank 12, and a refrigerant outlet hole 12*f* is opened in the cap 12*b*. An outlet connector 33 is disposed at a direct lower side position of the refrigerant outlet hole 12*f* to be connected to the refrigerant outlet hole 12*f*. That is, an inlet pipe 33*c* of the outlet connector 33 is fitted and connected to the refrigerant outlet hole 12*f*.

The outlet connector 33 is disposed to be connected with a refrigerant pipe 66 (see FIGS. 3, 4) of the refrigerant cycle system in the vehicle. Each of the outlet connector 33 and the inlet connector 16 is made of an aluminum material, and is formed into a block body having a potbellied shape. Refrigerant passages 33*a*, 16*a* are formed in the outlet connector 33 and the inlet connector 16, respectively, in a larger-diameter portion of the potbellied shape. In addition, screw holes (female screws) 33*b*, 16*b* are formed in the outlet connector 33 and the inlet connector 16, respectively, in a small-diameter portion of the potbellied shape. Through the screw holes 33*b*, 16*b*, the outlet connector 33 and the inlet connector 16 are connected to the refrigerant pipes 66, 68, respectively.

The inlet pipe 33*c* protrudes upwardly from an upper end of the refrigerant passage 33*a* penetrating through the outlet connector 33 in the up-down direction. In the first embodiment of the present invention, the inlet pipe 33*c* is integrally formed with the top end of the outlet connector 33. However, the inlet pipe 33*c* can be formed separately from the outlet connector 33.

Figure 4:
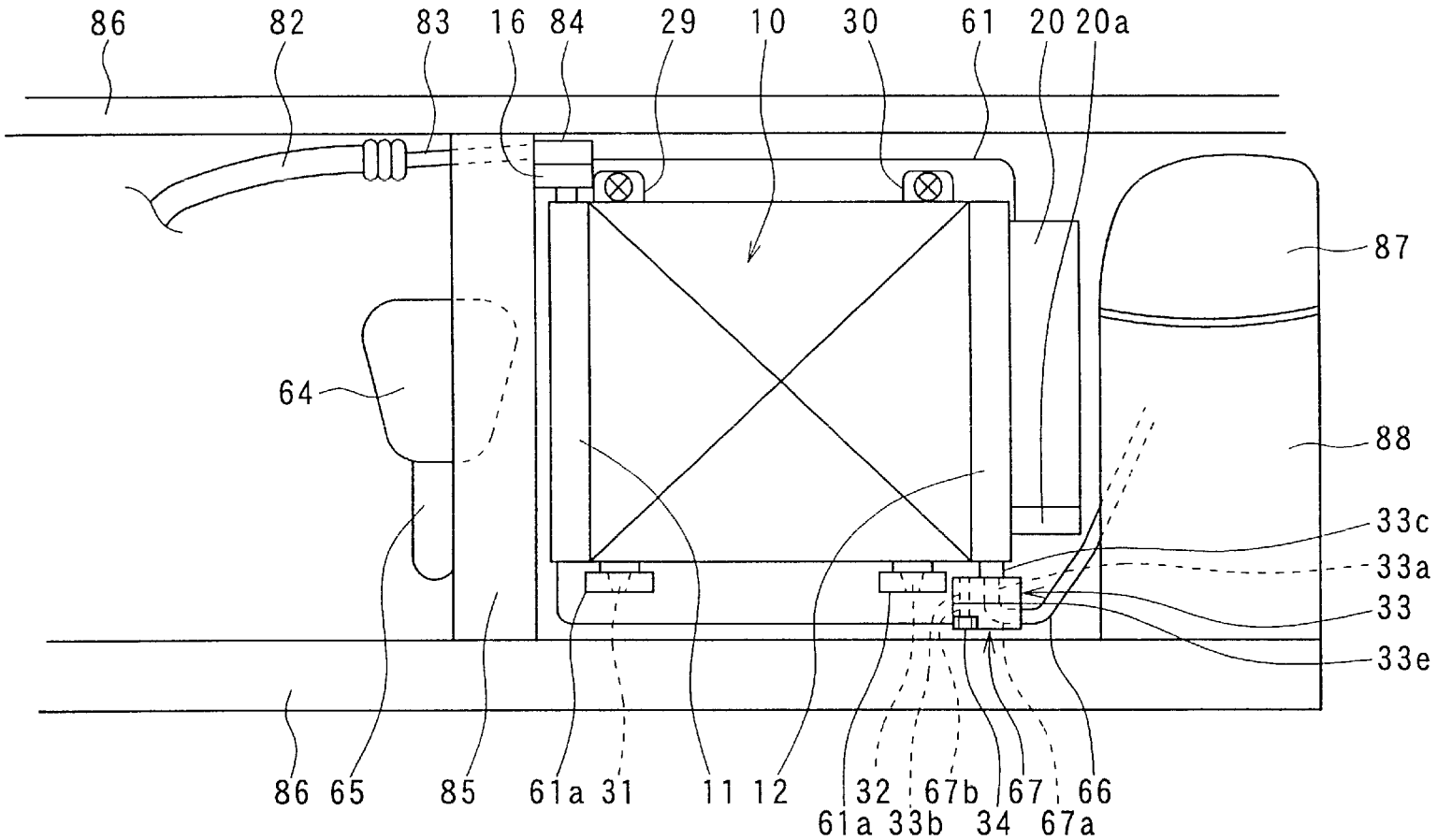
FIG. 4 is a front view showing a main part of the mounting structure of the receiver-integrated condenser according to the first embodiment.

A lower side flat surface of the outlet connector 33 is used as a connection surface 33*e* for connecting with a connector 67 for the refrigerant pipe 66. As shown in FIG. 4, a connection surface of the connector 67 for the refrigerant pipe 66 contacts the connection surface 33*e* of the outlet connector 33 from below.

Specifically, in the connector 67 at the side of the refrigerant pipe 66, a refrigerant passage 67*a* is provided to correspond to the refrigerant passage 33*a*, and an attachment hole 67*b* is provided to correspond to the attachment screw hole 33*b*. Accordingly, when the flat connection surface 33*e* of the connector 33 and flat connection surface 67*e* of the connector 67 contact, both the refrigerant passages 33*a*, 67*a* communicate with each other, and the attachment hole 67*b* of the connector 67 and the screw hole 33*b* of the connector 33 extend in line to be communicated with each other.

A bolt 34 is screwed into the screw hole 33*b* through the attachment hole 67*b*, so that both the connectors 33, 67 are tightly fastened. An elastic seal member (not shown) made of rubber is disposed in a connection position of the refrigerant passages 33*a*, 67*a* of both the connectors 33, 67, to air-tightly seal between the refrigerant passages 33*a*, 67*a* of both the connectors 33, 67.

In the receiver-integrated condenser 10 of FIG. 1, the other members except for the elastic support members 31, 32 are formed by an aluminum material. The other members of the receiver-integrated condenser 10 except for the elastic support members 31, 32 are temporally assembled in this state shown in FIG. 1, and the assembled body held by a suitable jig is transmitted into a burner to be integrally brazed.

Next, a mounting state of the receiver-integrated condenser 10 on the vehicle will be now described with reference to FIGS. 3 and 4. The receiver-integrated condenser 10 is disposed in an engine compartment 60 at a front side position of the radiator 61 in which cooling water of an engine 63 is cooled. The condenser 10 and the radiator 61 are disposed to be cooled by the cooling fan 62 driven electrically.

An exhaust manifold 64 and an exhaust pipe 65 of the engine 63 are disposed on a vehicle front side of the engine 63 at an approximate center position in the vehicle right-left direction. In the first embodiment, the first header tank 11 of the condenser 10, is positioned at a center side in the engine compartment 60 in the vehicle right-left direction. Accordingly, heat from the exhaust manifold 64 and exhaust pipe 65 is readily transmitted to the side of the first header tank 11, and is hardly transmitted to the side of second header tank 12 integrated with the receiving unit 20.

Figure 3:
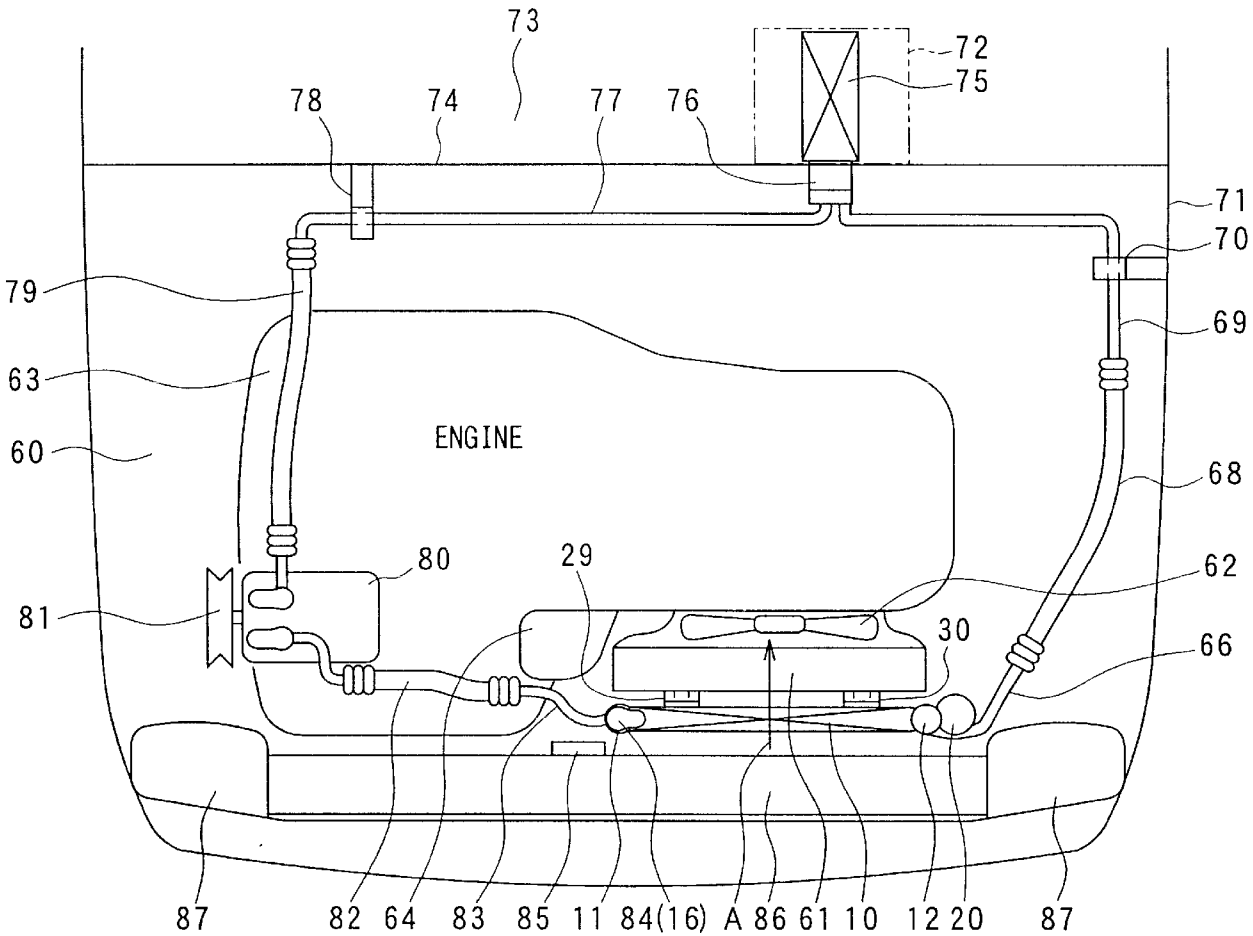
FIG. 3 is a plan view for explaining a mounting structure of the receiver-integrated condenser in a vehicle, according to the first embodiment.

The receiving unit 20 of the receiver-integrated condenser 10 is positioned to a vehicle left side (i.e., right side of FIGS. 3, 4). On the other hand, the refrigerant pipes 66, 68, 69 are disposed along the vehicle left sides for simply performing pipe-operation in the engine compartment 60. Accordingly, when the connector 33 for connecting the receiver-integrated condenser 10 to a vehicle-side pipe is disposed at the same side as the receiving unit 20, the connector 67 of the vehicle-side pipe such as the refrigerant pipe 66 can be directly connected to the connector 33.

The refrigerant pipe 66 is a metal pipe formed by an aluminum material, for example. One side end of the refrigerant pipe 66 is bonded to the connector 67 by brazing, and the other side end thereof is connected to an upstream end of a high-pressure side liquid-refrigerant rubber hose 68. The rubber hose 68 is disposed to extend in the engine compartment 60 along the vehicle left side (right side in FIG. 1) toward a vehicle rear side. A downstream end (rear side end) of the rubber hose 68 is connected to an upstream end of a liquid-refrigerant pipe 69 made of an aluminum material. The liquid-refrigerant pipe 69 is fixed to a vehicle body 71 positioned at a vehicle left side by a cramp 70.

An air conditioning unit 72 is disposed at a most front side in a passenger compartment 73 partitioned from the engine compartment 60 by a partition wall 74. That is, the air conditioning unit 72 is disposed at a direct rear side of the partition wall 74 in the passenger compartment 73. The air conditioning unit 72 has therein an evaporator 75 of the refrigerant cycle system, used as a cooling heat exchanger for cooling air passing therethrough. An expansion valve (decompression unit) 76, connected to a refrigerant inlet side and a refrigerant outlet side of the evaporator 75, protrudes into the engine compartment 60 through a through hole provided in the partition wall 74.

A downstream side end of the liquid-refrigerant pipe 69 is connected to a high-pressure side inlet portion of the expansion valve 76, and an upstream side end of a low-pressure gas-refrigerant pipe 77 is connected to a refrigerant outlet portion of the expansion valve 76. The low-pressure gas-refrigerant pipe 77 is fixed to the partition wall 74 by using a cramp 78.

A downstream end of the low-pressure gas-refrigerant pipe 77 is connected to a suction side of the compressor 80 through a low-pressure gas-refrigerant rubber hose 79. The compressor 80 for compressing and discharging refrigerant is rotated and driven by the engine 63 through an electromagnet clutch 81. A refrigerant discharge side of the compressor 80 is connected to a metal high-pressure gas-refrigerant pipe 83 through a discharge side rubber hose 82, and a connector 84 of the pipe 83 is connected to the inlet side connector 16 of the receiver-integrated condenser 10.

A hood lock stay 85 is disposed at a front side in the engine compartment 60 at an approximate center position in the vehicle right-left direction, headlights 87 are attached to a vehicle-front side frame 86 through a headlight support panel 88.

Next, operation of the refrigerant cycle system according to the first embodiment of the present invention will be now described. When operation of a vehicle air conditioner starts, and when the compressor 80 of the refrigerant cycle system is driven by the engine 63, the compressor 80 compresses and discharges high-pressure super-heating gas refrigerant. Super-heating gas refrigerant discharged from the compressor 80 flows into the upper space 11*c* of the first header tank 11 of the receiver-integrated condenser 10 from the inlet connector 16 as shown by arrow "a" in FIG. 1, through the hose 82 and the pipe 83. Thereafter, as shown by arrow "b", refrigerant flows through the tubes 14 of the condensing portion 25. In the condensing portion 25 of the core portion 13, gas refrigerant discharged from the compressor 80 is heat-exchanged with cooling air A (see FIGS. 2 and 3) through the tubes 14 and the fins 15, and is cooled so that a part of gas refrigerant from the compressor 80 becomes saturated liquid refrigerant. The saturated liquid refrigerant flows into the upper space 12*c* of the second header tank 12, and flows into the receiving unit 20 through the communication holes 21, 22 as shown by arrow "c".

Refrigerant flowing into the receiving unit 20 is separated into gas refrigerant and liquid refrigerant, and liquid refrigerant is stored in the receiving unit 20. Liquid refrigerant stored in the lower side part of the receiving unit 20 flows into the lower side space 12*d* of the second header tank 12 through the communication holes 13, 24 as shown by arrow "d", and thereafter, flows through the tubes 14 placed at an upper side in the super-cooling portion 26 from the lower space 12*d* of the second header tank 12 as shown by arrow "e". Liquid refrigerant is U-turned in the lower space 11*d* of the first header tank 11 as shown by arrow "f", and flows through tubes 14 at the lower side in the super-cooling portion 26 as shown by arrow "g" to be super-cooled. Thereafter, super-cooled liquid refrigerant flows into the refrigerant outlet space 12*e*, and flows outside of the receiver-integrated condenser 10 from the refrigerant outlet hole 12*f*.

Thereafter, super-cooled liquid refrigerant flows into the expansion valve 76 through the refrigerant pipes 66, 68, 69. In the expansion valve 76, super-cooled liquid refrigerant is decompressed to be low-temperature low-pressure gas-liquid refrigerant. Next, low-pressure gas-liquid refrigerant flows into the evaporator 75 from the expansion valve 76 to be heat-exchanged with air blown into the passenger compartment. Refrigerant is evaporated in the evaporator 75 by absorbing heat from air. Gas refrigerant from the evaporator 75 is sucked into the compressor 80 through the refrigerant pipe 77 and the refrigerant hose 79.

According to the first embodiment of the present invention, when the receiver-integrated condenser 10 is disposed at the front side in the engine compartment 60, the second header tank 12 and the receiving unit 20 integrated with the second header tank 12 are disposed at one end side of the engine compartment 60 in the vehicle right-left direction, and the first header tank 11 is disposed at a center side in the vehicle right-left direction. Therefore, the receiving unit 20 can be disposed at a position away from the exhaust manifold 64 and the exhaust pipe 65, and it can prevent heat from a high-temperature portion of the engine 63 from being transmitted to the receiving unit 20. Accordingly, it can prevent liquid refrigerant in the receiving unit 20 from being gasified, and refrigerant cycle performance of the refrigerant cycle system can be improved.

The refrigerant passage in the super-cooling portion 26 is constructed, so that refrigerant is U-turned in the first header tank 11 positioned at the center side of the engine compartment in the vehicle right-left direction, and the refrigerant outlet space 12*e* and refrigerant outlet hole 12*f* of the super-cooling portion 26 are positioned at the end side in the vehicle right-left direction. That is, the refrigerant outlet space 12*e* and the refrigerant outlet hole 12*f* are disposed at the same side as the receiving unit 20 in the receiver-integrated condenser 10 in the vehicle right-left direction. Accordingly, the connector 67 of the refrigerant pipe 66, positioned at the end side in the vehicle right-left direction can be readily directly connected to the outlet connector 33 of the receiver-integrated condenser 10.

In addition, the outlet connector 33 is disposed at a direct lower position of the refrigerant outlet space 12*e* and the refrigerant outlet hole 12*f* of the super-cooling portion 26. Therefore, as shown in FIG. 2, the outlet connector 33 can be disposed within a thickness dimension range in the vehicle front-rear direction and a width dimension range in the vehicle right-left direction of the receiver-integrated condenser 10. Further, a refrigerant outlet 33*d* of the outlet connector 33 is positioned to be opened toward downwardly, and the lower side surface of the connector 33 is used as the connection surface 33*e* connecting with the connector 67 of the refrigerant pipe 66. Therefore, as shown in FIG. 4, the connector 67 of the refrigerant pipe 66 can be disposed at a direct lower side of the outlet connector 33 of the receiver-integrated condenser 10, so that the connection of both the connectors 33, 67 can be readily performed. As a result, a connection portion between both the connectors 33, 67 can be disposed within the dimension ranges of the receiver-integrated condenser 10 in the vehicle front-rear direction and the vehicle right-left direction, and mounting performance of the receiver-integrated condenser 10 in the vehicle can be improved.

Because the connectors 33, 67 are disposed at the position directly below from the refrigerant outlet space 12*e* of the second header tank 12, the connectors 33, 67 are not positioned directly under the receiving unit 20. Therefore, an attachment or a detachment of the cap member 20*a* positioned at the bottom portion of the receiving unit 20 can be readily performed.

In FIG. 1, refrigerant flows through the tubes 14 of the condensing portion 25 in one way as shown by arrow "b". However, when the number of the tubes 14 of the condensing portion 25 is increased and separators similarly to the separators 18, 19*a*, 19*b* are additionally disposed in the first and second header tanks 11, 12, refrigerant can flow through the condensing portion 25 meanderingly.

Figure 5B:
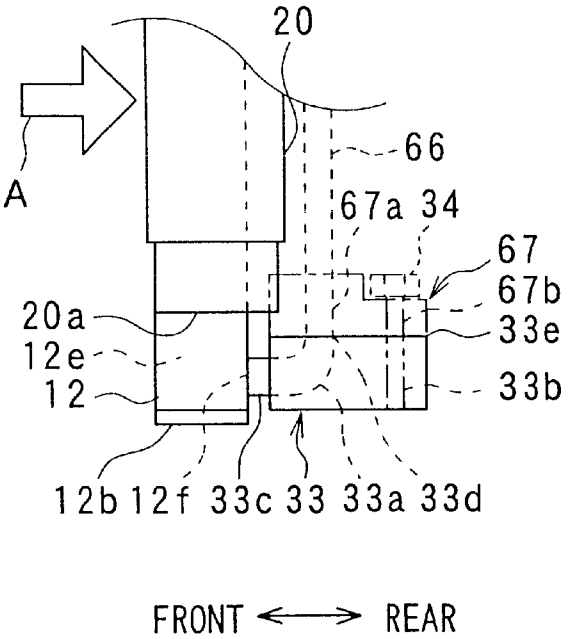
FIG. 5A and FIG. 5B are a front view and a side view, respectively, each showing a part of a receiver-integrated condenser according to a second preferred embodiment of the present invention.
Figure 5A:
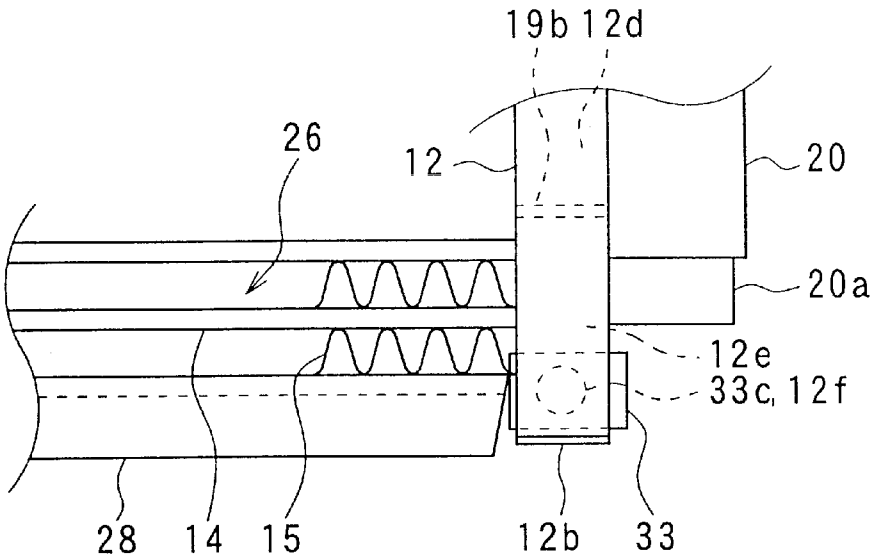

A second preferred embodiment of the present invention will be now described with reference to FIGS. 5A and 5B. In the above-described first embodiment of the present invention, the inlet pipe 33*c* being connected to the refrigerant outlet space 12*e* is disposed on the upper side of the outlet connector 33, the refrigerant outlet 33*d* of the outlet connector 33 is disposed to be toward downwardly, and the bottom surface of the outlet connector 33 is used as the connection surface 33*e* connecting with the connector 67 of the refrigerant pipe 66. However, in the second embodiment of the present invention, the outlet connector 33 is disposed at a vehicle rear side of the refrigerant outlet space 12*e* at the lower side position of the second header tank 12, as shown in FIGS. 5A and 5B. Therefore, the outlet connector 33 can be disposed at a position offset to a side of the receiving unit 20 when being viewed from a top side of the receiving unit 20.

The inlet pipe 33*a* protrudes toward a vehicle front side from a front end surface of the outlet connector 33 to be connected to the refrigerant outlet hole 12*f* of the refrigerant outlet space 12*e*. Further, the refrigerant outlet 33*d* of the refrigerant passage of the refrigerant pipe 33*a* of the outlet connector 33 is provided to be toward upwardly, and a top end surface of the connector 33 is used as the connection surface 33*e* connecting with the connector 67 of the refrigerant pipe 66 on the vehicle side.

Because the connection surface 33*e* of the outlet connector 33 is toward the upper side, the connector 67 of the refrigerant pipe 66 is disposed on the connection surface 33*e* of the outlet connector 33. Therefore, by screwing the bolt 34 into the connectors 33, 67 from the upper side of both the connectors 33, 67, both the connectors 33, 67 can be readily connected. Even in the second embodiment, because the outlet connector 33 is disposed to be offset to a side (e.g., vehicle rear side) of the receiving unit 20 when being viewed from the upper side of the receiving unit 20, the cap member 20*a* can be detachably disposed.

In the second embodiment, the other parts are similar to those in the above-described first embodiment.

Figure 6:
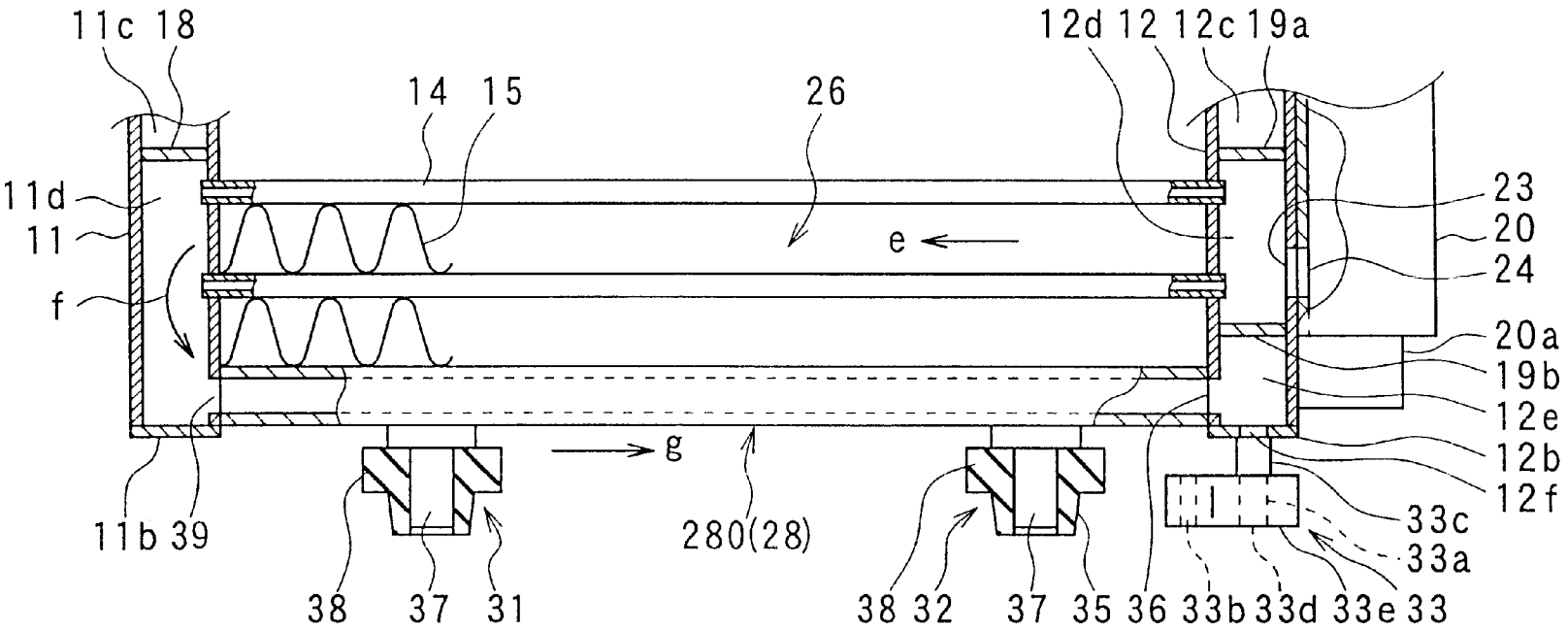
FIG. 6 is a partially-sectional front view showing a receiver-integrated condenser according to a third preferred embodiment of the present invention.
Figure 7B:
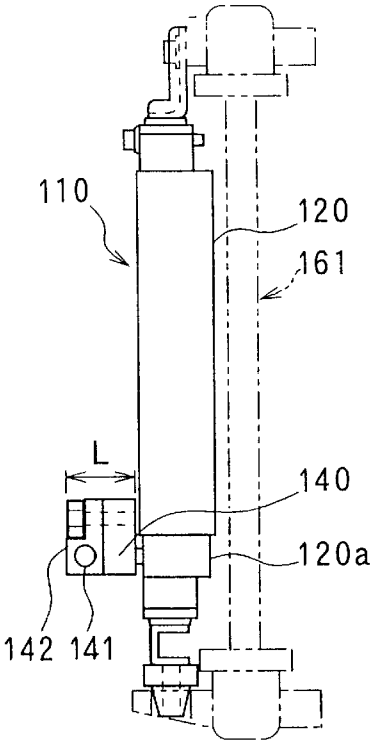
FIG. 7A and FIG. 7B are a front view and a side view, respectively, each showing a receiver-integrated condenser in a related art.
Figure 7A:
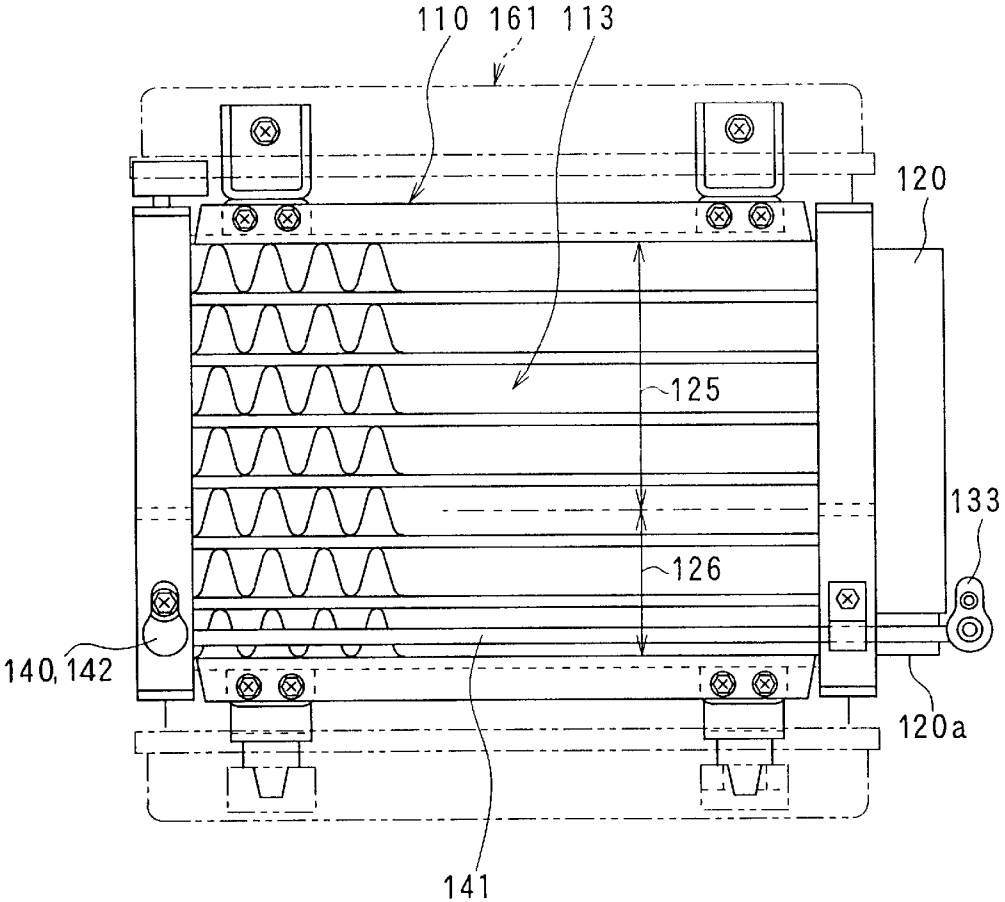

A third preferred embodiment of the present invention will be now described with reference to FIG. 6. In the third embodiment, a pipe member 280 defining a refrigerant passage is disposed at a position corresponding to the lower side plate 28 described in the first and second embodiments. The refrigerant passage of the pipe member 280 is used as a most bottom refrigerant passage in the super-cooling portion 26. Here, a sectional shape of the pipe member 280 may be a round shape or a square shape. However, for readily bonding the pipe member 280 to the corrugated fin 15 and for increasing heat exchanging performance with the corrugated fin 15, the pipe member 280 is generally formed to have a flat tube shape. The pipe member 280 can be integrally molded by extrusion. Alternatively, the pipe member 280 can be integrally brazed after a plate member is bent to a pipe shape.

A communication hole 39 is opened in the first header tank 11 at a position proximate to the bottom end of the first header tank 11. One end portion (upstream side end) of the pipe member 280 is brazed to the first header tank 11 around the communication hole 39 to communicate with the lower space lid of the first header tank 11, and the other end portion (downstream side end) of the pipe member 280 is connected to the second header tank 12 around a communication hole 36 to communicate with the refrigerant outlet space 12*e*. Further, the refrigerant outlet hole 12*f* is opened in the lower cap 12*b* of the second header tank 12 to communicate with and to be connected to the outlet connector 33. Accordingly, the lower space lid of the first header tank 11 communicates with the outlet connector 33 through the pipe member 280 and the refrigerant outlet space 12*e* at the bottom side in the second header tank 12.

Further, the elastic support members 31, 32 are disposed in the bottom surface portion of the pipe member 280 at both right and left positions. In the third embodiment of the present invention, metal support pins 37 are bonded to the bottom surface portion of the pipe member 280, and are press-fitted into the elastic members 38. The elastic members 38 are made of an elastic material such as a rubber, and is formed into a cylindrical shape.

According to the third embodiment of the present invention, the pipe member 280 corresponding to the lower side plate 28 of the first embodiment is used as the refrigerant passage, the number of the tubes 14 can be reduced in the super-cooling portion 26. Therefore, the receiver-integrated condenser 10 can be manufactured in low cost.

Although the present invention has been fully described in connection with the preferred embodiments thereof with reference to the accompanying drawings, it is to be noted that various changes and modifications will become apparent to those skilled in the art.

For example, even in the above-described third embodiment of the present invention, the outlet connector 33 can be disposed similarly to the arrangement of the above-described second embodiment of the present invention by using the bolt 34. In addition, in the third embodiment shown in FIG. 6, the pipe connection direction of the outlet connector 33 can be suitably set in any one of the vehicle front-rear direction and vehicle right-left direction.

In the above-described second embodiment of the present invention, the outlet connector 33 is disposed at a vehicle rear side of the second header tank 12. However, the outlet connector 33 can be disposed at a vehicle rear side of the receiving unit 20, for example. That is, the outlet connector 33 can be disposed at an any position offset to a side of the receiving unit 20 when being viewed from an upper side of the receiving unit 20.

In the above-described embodiments of the present invention, the side wall surface of the receiving unit 20 is bonded to the second header tank 12 along an entire length in the up-down direction. However, in the up-down direction of the receiving unit 20, clearances can be provided between the side wall surface of the receiving unit 20 and the second header tank 12 at positions without forming the communication holes 22, 24, and the receiving unit 20 and the second header tank 12 can be partially bonded in the up-down direction.

Further, the whole receiving unit 20 in the up-down direction can be disposed separately from the second header tank 12 by a predetermined distance, and the communication holes 21, 23 of the second header tank 12 communicate with the communication holes 22, 24 of the receiving unit 20 through suitable communication pipes, respectively. Alternatively, suitable connectors can be bonded to the communication holes 21, 23 of the second header tank 12, and can be connected to connectors having the communication holes 22, 24 of the receiving unit 20 by using fastening means.

In the above-described embodiments of the present invention, in the super-cooling portion 26, the flow of refrigerant is U-turned at one position in the first header tank 11. However, the flow of refrigerant can be U-turned at plural position more that two position in the first header tank 11.

Such changes and modifications are to be understood as being within the scope of the present invention as defined by the appended claims.

What is claimed is:

1. A receiver-integrated condenser for a refrigerant cycle system of a vehicle, comprising:

a condensing portion for cooling and condensing refrigerant discharged from a compressor of the refrigerant cycle system;

a receiving unit which is disposed to separate refrigerant from the condensing portion into gas refrigerant and liquid refrigerant and to store liquid refrigerant therein;

a super-cooling portion for super-cooling liquid refrigerant from the receiving unit; and a connector, connected to a refrigerant outlet portion of the super-cooling portion, through which the refrigerant outlet portion is connected to a refrigerant pipe of the refrigerant cycle system, wherein:

the condensing portion and the super-cooling portion are disposed to construct a core portion in which refrigerant is heat-exchanged with air;

in the core portion, the super-cooling portion is disposed at a lower side of the condensing portion;

the receiving unit is disposed at one end side of the core portion in a width direction of the core portion to extend in a vertical direction perpendicular to the width direction;

the super-cooling portion is disposed to define a refrigerant passage, in such a manner that refrigerant is U-turned in the refrigerant passage at the other end side of the core portion in the width direction, and the refrigerant outlet portion of the super-cooling portion is positioned at the one end side in the width direction;

the connector is disposed at a lower side of the refrigerant outlet portion; and the connector has a refrigerant outlet port opened toward downwardly, and a bottom surface used as a connection surface connecting with a pipe connector of the refrigerant pipe.

2. The receiver-integrated condenser according to claim 1, wherein:

the condensing portion and the super-cooling portion have a plurality of tubes extending in the width direction in the core portion, through which refrigerant flows in the width direction, and first and second header tanks disposed at both end sides in the width direction to extend in the vertical direction perpendicular to the width direction;

one side ends of the tubes are disposed to communicate with the first header tank, and other side ends of the tubes are disposed to communicate with the second header tank disposed at the side of the receiving unit;

each of the first and second header tanks has therein a one partition member for partitioning each interior of the first and second header tanks into an upper side space communicating with the tubes in the condensing portion, and a lower side space communicating with the tubes in the super-cooling portion;

the second header tank and the receiving unit are disposed in such a manner that refrigerant in the upper side space of the second header tank flows into the receiving unit;

the lower side space of the second header tank is disposed to communicate with a lower side position within the receiving unit in such a manner that liquid refrigerant in the receiving unit flows into the lower side space of the second header tank;

the second header tank has therein an another partition member at a lower side position of the one partition member to define a refrigerant outlet space of the super-cooling portion under the lower side space; and the refrigerant outlet portion is provided in the refrigerant outlet space.

3. The receiver-integrated condenser according to claim 2, further comprising:

a pipe member, defining a refrigerant passage, disposed at a bottom portion of the core portion, wherein the pipe member has a refrigerant upstream end disposed to communicate with the lower side space of the first header tank, and a refrigerant downstream end disposed to communicate with the refrigerant outlet space.

4. The receiver-integrated condenser according to claim 2, wherein:

the second header tank and the receiving unit are disposed to have a first communication hole through which the upper side space of the second header tank communicates with the receiving unit at a position upper than the one partition member, and a second communication hole through which a lower side of the receiving unit communicates with the lower side space of the second header tank; and the receiving unit has a cap member detachably disposed at a bottom portion of the receiving unit.

5. The receiver-integrated condenser according to claim 1, wherein the connector connected to the refrigerant outlet portion of the super-cooling portion is disposed to be connected to the pipe connector of the refrigerant pipe by using a screw member.

6. The receiver-integrated condenser according to claim 1, wherein the receiving unit and the connector positioned at the one end side of the core portion is disposed at an end sid e in an engine compartment of the vehicle in a vehicle right-left direction, and the other side end of the core portion is disposed at a center side in the vehicle right-left direction.

7. The receiver-integrated condenser according to claim 2, wherein:

the second header tank has a tank cap disposed at a bottom portion of the second header tank;

the tank cap has a refrigerant outlet hole used as the refrigerant outlet portion; and the connector is disposed at a direct lower side of the cap to communicate with the refrigerant outlet hole.

8. The receiver-integrated condenser according to claim 2, wherein the first header tank has a refrigerant inlet through which refrigerant from the compressor of the refrigerant cycle system flows into the upper side space of the first header tank.

9. A receiver-integrated condenser for a refrigerant cycle system of a vehicle, comprising:

a condensing portion for cooling and condensing refrigerant discharged from a compressor of the refrigerant cycle system;

a receiving unit which is disposed to separate refrigerant from the condensing portion into gas refrigerant and liquid refrigerant and to store liquid refrigerant therein;

a super-cooling portion for super-cooling liquid refrigerant from the receiving unit; and a connector, connected to a refrigerant outlet portion of the super-cooling portion, through which the refrigerant outlet portion is connected to a refrigerant pipe of the refrigerant cycle system, wherein:

the condensing portion and the super-cooling portion are disposed to construct a core portion in which refrigerant is heat-exchanged with air;

in the core portion, the super-cooling portion is disposed at a lower side of the condensing portion;

the receiving unit is disposed at one end side of the core portion in a width direction of the core portion to extend in a vertical direction perpendicular to the width direction;

the super-cooling portion is disposed to define a refrigerant passage, in such a manner that refrigerant is U-turned in the refrigerant passage at the other end side of the core portion in the width direction, and the refrigerant outlet portion of the super-cooling portion is positioned at the one end side in the width direction;

the connector is connected to the refrigerant outlet portion to be shifted to a side of the receiving unit when being viewed from an upper side of the receiving unit; and the connector has a refrigerant outlet port opened toward upwardly, and a top surface used as a connection surface connecting with a pipe connector of the refrigerant pipe.

10. The receiver-integrated condenser according to claim 9, wherein:

the condensing portion and the super-cooling portion have a plurality of tubes extending in the width direction in the core portion, through which refrigerant flows in the width direction, and first and second header tanks disposed at both end sides in the width direction to extend in the vertical direction perpendicular to the width direction;

one side ends of the tubes are disposed to communicate with the first header tank, and other side ends of the tubes are disposed to communicate with the second header tank disposed at the side of the receiving unit;

each of the first and second header tanks has therein a one partition member for partitioning each interior of the first and second header tanks into an upper side space communicating with the tubes in the condensing portion, and a lower side space communicating with the tubes in the super-cooling portion;

the second header tank and the receiving unit are disposed in such a manner that refrigerant in the upper side space of the second header tank flows into the receiving unit;

the lower side space of the second header tank is disposed to communicate with a lower side position within the receiving unit in such a manner that liquid refrigerant in the receiving unit flows into the lower side space of the second header tank;

the second header tank has therein an another partition member at a lower side position of the one partition member to define a refrigerant outlet space of the super-cooling portion under the lower side space; and the refrigerant outlet portion is provided in the refrigerant outlet space.

11. The receiver-integrated condenser according to claim 10, further comprising:

a pipe member, defining a refrigerant passage, disposed at a bottom portion of the core portion, wherein the pipe member has a refrigerant upstream end disposed to communicate with the lower side space of the first header tank, and a refrigerant downstream end disposed to communicate with the refrigerant outlet space.

12. The receiver-integrated condenser according to claim 10, wherein:

the second header tank and the receiving unit are disposed to have a first communication hole through which the upper side space of the second header tank communicates with the receiving unit at a position upper than the one partition member, and a second communication hole through which a lower side of the receiving unit communicates with the lower side space of the second header tank; and the receiving unit has a cap member detachably disposed at a bottom portion of the receiving unit.

13. The receiver-integrated condenser according to claim 9, wherein the connector connected to the refrigerant outlet portion of the super-cooling portion is disposed to be connected to the pipe connector of the refrigerant pipe by using a screw member.

14. The receiver-integrated condenser according to claim 9, wherein the receiving unit and the connector positioned at the one end side of the core portion is disposed at an end side in an engine compartment of the vehicle in a vehicle right-left direction, and the other side end of the core portion is disposed at a center side in the vehicle right-left direction.

* * * * *